US006333701B1

(12) United States Patent
Mee et al.

(10) Patent No.: US 6,333,701 B1
(45) **Date of Patent: *Dec. 25, 2001**

(54) VIBRATION ACTUATED TRAFFIC MONITORING SYSTEM

(76) Inventors: Gary L. Mee, 12410 Rocky Knoll, Houston, TX (US) 77077; Clint A. Davis, 4535 Birch St., Bellaire, TX (US) 77401

( * ) Notice: Subject to any disclaimer, the term of this patent is extended or adjusted under 35 U.S.C. 154(b) by 0 days.

This patent is subject to a terminal disclaimer.

(21) Appl. No.: 09/360,231

(22) Filed: Jul. 23, 1999

Related U.S. Application Data

(63) Continuation of application No. 08/758,031, filed on Nov. 27, 1996, now Pat. No. 5,929,787.

(51) Int. Cl.[7] ..... G08G 1/095

(52) U.S. Cl. ..... 340/907; 340/908; 340/933; 340/683

(58) Field of Search ..... 340/907, 908, 340/933, 683, 904, 902, 905, 909, 910, 916, 917, 925, 938, 940, 939

(56) References Cited

U.S. PATENT DOCUMENTS

| | | | | |
|---|---|---|---|---|
| 2,419,099 | * | 4/1947 | Wall | 340/937 |
| 3,060,434 | * | 10/1962 | Biedermann et al. | 340/937 |
| 3,573,724 | * | 4/1971 | Komorida | 340/937 |
| 4,908,616 | * | 3/1990 | Walker | 340/929 |
| 5,041,828 | * | 8/1991 | Loeven | 340/937 |
| 5,131,477 | * | 7/1992 | Stagg et al. | 175/40 |
| 5,646,340 | * | 7/1997 | Gee et al. | 73/116 |
| 5,912,822 | * | 6/1999 | Davis et al. | 340/936 |
| 5,929,787 | * | 7/1999 | Mee et al. | 340/907 |
| 5,935,190 | * | 8/1999 | Davis et al. | 701/119 |
| 5,948,038 | * | 9/1999 | Daly et al. | 701/117 |
| 6,014,595 | * | 1/2000 | Kobayashi | 701/1 |
| 6,111,523 | * | 8/2000 | Mee | 340/937 |

* cited by examiner

*Primary Examiner*—Nina Tong
(74) *Attorney, Agent, or Firm*—Moser, Patterson & Sheridan, L.L.P.

(57) ABSTRACT

A device for controlling a traffic light, where the controlling of the traffic light is dependent upon receipt and recognition of vibrations. The device includes a vibration receiver for detecting vibrations transmitted through the ground, a processor for converting one or more of the vibrations into a control signal and a controller to trigger a traffic light in response to the control signal. The device may also include a vibration generator, e.g., at least one channel or groove in a traffic-bearing surface. The vibration generator preferably facilitates the production of a pattern of vibrations when the tire of a vehicle passes over the vibration generator. Further, the device may include a vibration receiver, capable of detecting a pattern of vibrations and producing a pattern of signals corresponding to said pattern of vibrations.

16 Claims, 7 Drawing Sheets

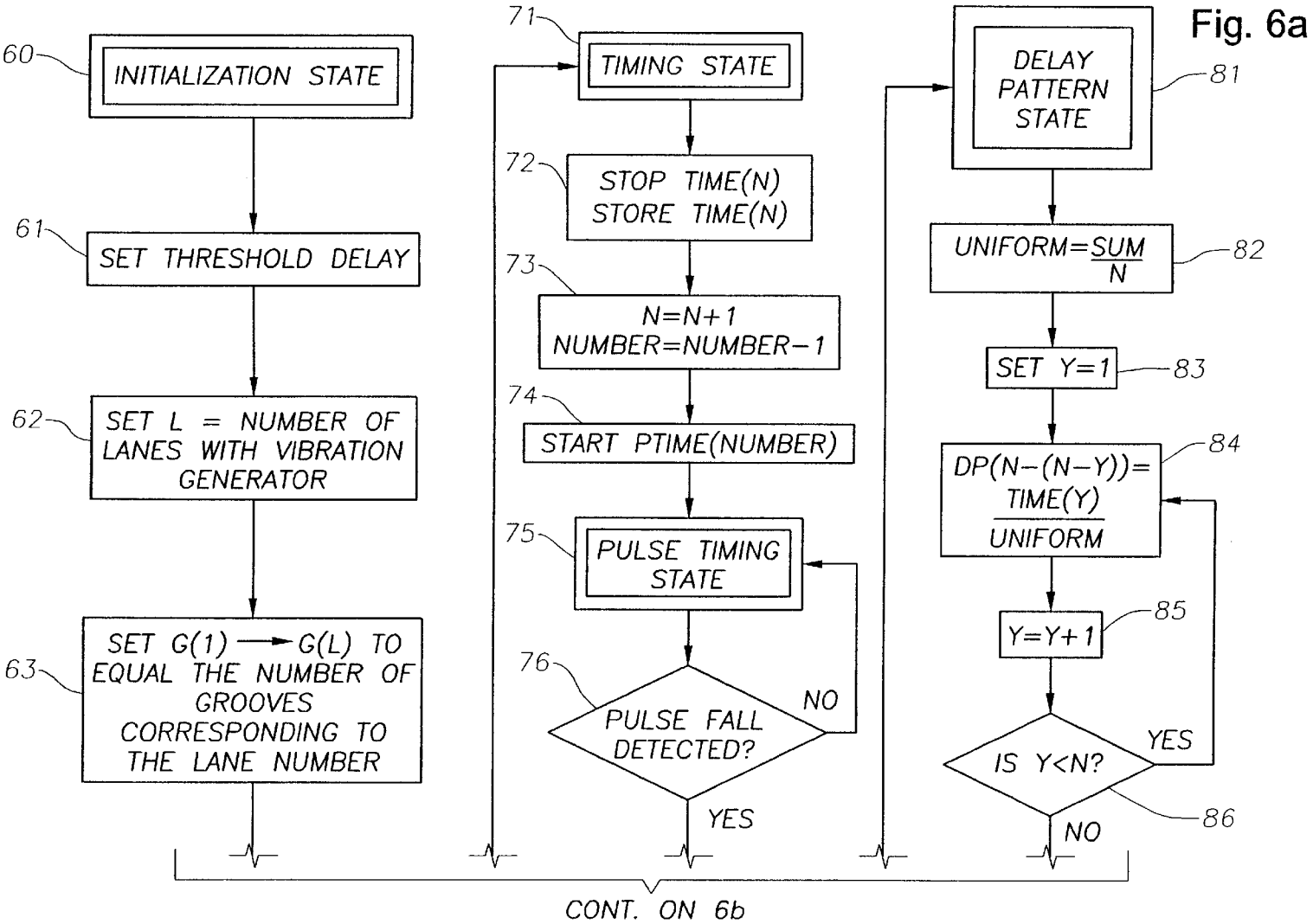
Fig. 6a
INITIALIZATION STATE
60
SET THRESHOLD DELAY
61
SET L = NUMBER OF LANES WITH VIBRATION GENERATOR
62
SET G(1) → G(L) TO EQUAL THE NUMBER OF GROOVES CORRESPONDING TO THE LANE NUMBER
63
TIMING STATE
71
STOP TIME(N) STORE TIME(N)
72
N=N+1 NUMBER=NUMBER−1
73
START PTIME(NUMBER)
74
PULSE TIMING STATE
75
PULSE FALL DETECTED?
76
NO
YES
DELAY PATTERN STATE
81
UNIFORM=SUM/N
82
SET Y=1
83
DP(N−(N−Y))= TIME(Y)/UNIFORM
84
Y=Y+1
85
IS Y<N?
86
YES
NO
CONT. ON 6b CONT. FROM 6a
SET THE GROOVE PATTERN FOR EACH VIBRATION GENERATOR IN EACH LANE
GP(1,1) → GP(1,G(1)−1)
GP(L,1) → GP(L,G(L)−1)
64
RECOGNITION STATE
65
SET NUMBER = 0
SET N = 0
SET SUM = 0
SET UNIFORM = 0
66
STOP
PTIME(NUMBER)
STORE
PTIME(NUMBER)
77
SUM = SUM + PTIME(NUMBER)
78
DELAY TIMING STATE
79
START TIME(N)
80
LA=1
87
X=1
88
DOES DP(X)= GP(LA,X) ?
89
NO
YES
LA=LA+1
90
X=X+1
92
IS X<N?
93
YES
NO
IS LA>L ?
91
NO
YES
CONT. ON 6c

VIBRATION ACTUATED TRAFFIC MONITORING SYSTEM

CROSS REFERENCES TO RELATED APPLICATIONS

This is a continuation application of U.S. application, Ser. No. 08/758,031, filed Nov. 27, 1996 which is now U.S. Pat. No. 5,929,787.

BACKGROUND OF THE INVENTION

1. Field Of The Invention

Broadly, this invention relates to traffic monitoring and in a specific embodiment to a system for controlling traffic lights at traffic intersections by detecting and processing vibrations actuated by a vehicle passing over a vibration generator. In another specific embodiment, the invention relates to a system which utilizes a vibration receiver to detect vibrations and a processor to convert the vibrations into a control signal which triggers traffic lights.

2. Description Of Related Art

A well-known fixture at traffic intersections is the common "traffic light," which traditionally has three "light elements," red, yellow, and green. Traffic lights are typically used to prevent collisions at intersections, to determine which vehicle has the right-of-way, and to control traffic flow.

Many, if not most, traffic intersections have a predetermined timing mechanism that sets a time for the traffic light's green light element, yellow light element and red light element to be activated. The various traffic lights at the intersection are coordinated by the timing mechanism to control traffic flow. For example, when vehicles traveling in one direction through an intersection see a green light, vehicles traveling through the intersection in a way that could result in a collision are faced with a red light. With this mechanism, the time that a traffic light remains in one state, i.e., the time the green light element is activated, before switching to the other element is often preselected based on the anticipated traffic flow through the intersection. For example, if a large business street intersects with a small residential street, then the traffic timing mechanism and traffic lights may be preset to activate the green light element for the business street for longer time than for the residential street.

Other traffic light systems have a variable timing mechanism that is responsive to the actual flow of traffic. These systems are far superior in terms of controlling traffic flow since the often inaccurate estimation of anticipated traffic flow can be eliminated and the actual traffic flow can trigger the timing of the traffic lights. For example, these systems may utilize an actuating element that is disposed and embedded in a traffic-bearing surface. For example, traffic lights at intersections are often connected to inductive loops. The inductive loops provide a signal responsive to the presence of a vehicle passing over the loops. However, these and other types of embedded element systems have various shortcomings. They are costly and inconvenient since the road surface must be excavated in order to implant the sensors. For example, it is not unusual for mere sensor installation of such an embedded system to be highly expensive, which is, of course, borne by the taxpayer. Consequently, it may be cost prohibitive to install such system at an intersection. Further, since the actuating elements, e.g., the inductive loops, are physically connected to the processor and controller of the traffic light system, these systems are, for the most part, permanent, thus preventing easy removal and implementation at another location.

SUMMARY OF INVENTION

In a broad aspect, this invention relates to traffic monitoring. In a specific embodiment, the invention is directed to a method and apparatus for accurately controlling a traffic light, preferably upon receipt of a pattern of vibrations produced by the passing of a vehicle over a vibration generator. Preferably, the traffic monitoring system processes the vibrations to produce control signals which operate peripheral devices such as traffic lights. The control signal may also activate other peripheral devices such as speed monitoring devices, traffic cameras or traffic counters.

In a specific embodiment, an apparatus of the invention includes a device for controlling a traffic light, where the controlling of the traffic light is dependent upon receipt and recognition of vibrations. The device includes a vibration receiver for detecting vibrations transmitted through the ground, i.e., "ground vibrations," a processor for converting one or more of the vibrations into a control signal and a controller to trigger a traffic light in response to the control signal. The device may also include a vibration generator, e.g., at least one channel or groove in a traffic-bearing surface. The vibration generator preferably facilitates the production of a pattern of vibrations when the tire of a vehicle passes over the vibration generator. Further, the device may include a vibration receiver, preferably a geophone, capable of detecting a pattern of vibrations and producing a pattern of signals corresponding to said pattern of vibrations.

In a specific embodiment, a method of the invention includes the steps of detecting vibrations transmitted through the ground, where such vibrations are incited by a vehicle passing over a vibration generator. Further steps may include converting the vibrations into a control signal and triggering a traffic light in response to the control signal. The method may also include the steps of detecting a pattern of vibrations and converting the pattern into a control signal if the pattern matches a reference pattern. Further, the method may also include the step of triggering a traffic light to switch from a red light to a green light when a preselected pattern of vibrations is detected and converted into a control signal.

In a specific embodiment, the vibration generator comprises at least one channel or groove in the traffic bearing surface. Preferably, each of the grooves or channels extends across the traffic-bearing surface substantially perpendicular to the flow of traffic. The number of channels or grooves and the pattern of spacing between channels or grooves may be used to distinguish the vibration pattern, thus fostering lane discrimination and recognition. The specific dimension and geometry of each of the grooves or channels may also be used to generate distinct vibrations to further distinguish vibration patterns. This embodiment is advantageous in that it can be easily and inexpensively implemented. For example, instead of requiring days of excavation and resurfacing of the traffic bearing surface to implant a sensor, grooves or channels can be "cut" into the traffic bearing surface quickly and easily using a conventional concrete cutter. Alternatively, the vibration generator may include raised strips, bumps, or cables stretched perpendicularly across the traffic-bearing surface. The grooves, channels, strips, bumps, or cables may also emanate distinct vibrations recognizable to the geophone according to their number, spacing, geometry, and dimensions.

In a preferred embodiment, the vibration receiver comprises a geophone, which is preferably positioned proximate the traffic-bearing surface, e.g., partially buried in the ground next to the roadside. Since the vibration receiver is not physically connected to the vibration generator, it can be installed and moved with little expense or difficulty. This is unlike other systems where sensors are imbedded in the traffic-bearing surface, thus requiring expensive and time consuming excavation to salvage monitoring system components or to move the monitoring system to a new location. Further, unlike other systems, repairs of the vibration receiver can be easily performed without tearing up the traffic bearing surface. Thus, this embodiment is advantageous in that it still maintains the superiority of controlling traffic flow based on the actual traffic in the area and avoids the cost prohibitive, installation, excavation and maintenance of other systems.

In another specific embodiment, the control signal produced by the processing circuit activates a traffic light to switch from red to green for an approaching vehicle. (Of course, such a system would preferably also activate another traffic light to switch from green to yellow, then to red, for intersecting traffic.) This control signal is produced when the vibration receiver detects a vibration pattern which matches a preselected or reference pattern.

DETAILED DESCRIPTION OF SPECIFIC EMBODIMENTS

Figure 1:
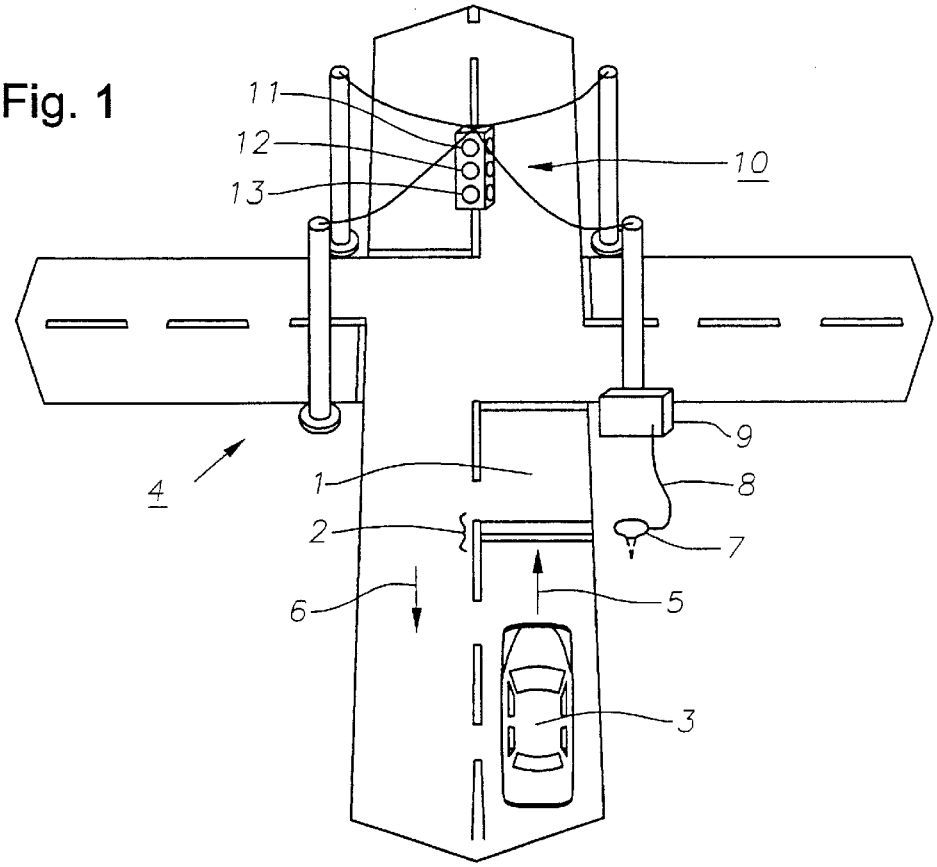
FIG. 1 is a schematic drawing of a traffic intersection showing a vehicle interacting with a vibration generator, a vibration receiver, a housing for a processor and controller, and a traffic light in accordance with a specific embodiment of the invention.

Specific embodiments of the invention will now be described as part of the detailed description. In the drawings, like elements have the same reference numbers for purposes of simplicity. It is understood that the invention is not limited to the specific examples and embodiments, including those shown in the drawings, which are intended only to assist a person skilled in the art in practicing the invention. Many modifications and improvements may be made without departing from the scope of the invention, which should be determined based on the claims below, including any equivalents thereof.

In a broad aspect, this invention relates to traffic monitoring. In a specific embodiment, the invention is directed to a method and apparatus for accurately controlling a traffic light 10 at traffic intersection 4, preferably upon receipt or recognition of a pattern of vibrations produced by the passing of vehicle 3 over a vibration generator 2, as shown in FIG. 1. The pattern of vibrations correspond to the predetermined pattern of grooves comprising the vibration generator. Preferably, the traffic monitoring system processes the vibrations to produce control signals which operate peripheral devices such as traffic lights. The processor produces a control signal if the processed vibration pattern corresponds with the predetermined groove pattern, i.e., the grooves and the internal spacing of such. The correspondence is preferably determined by measuring the delay between vibration pulses as compared to the actual spacing of the grooves or channels.

Alternatively, the correspondence may also be determined by comparing the magnitude of the vibration pulse caused by the vibration generator with expected ranges of magnitudes. The control signal may also activate other peripheral devices such as speed monitoring devices, traffic cameras or traffic counters.

Figure 4:
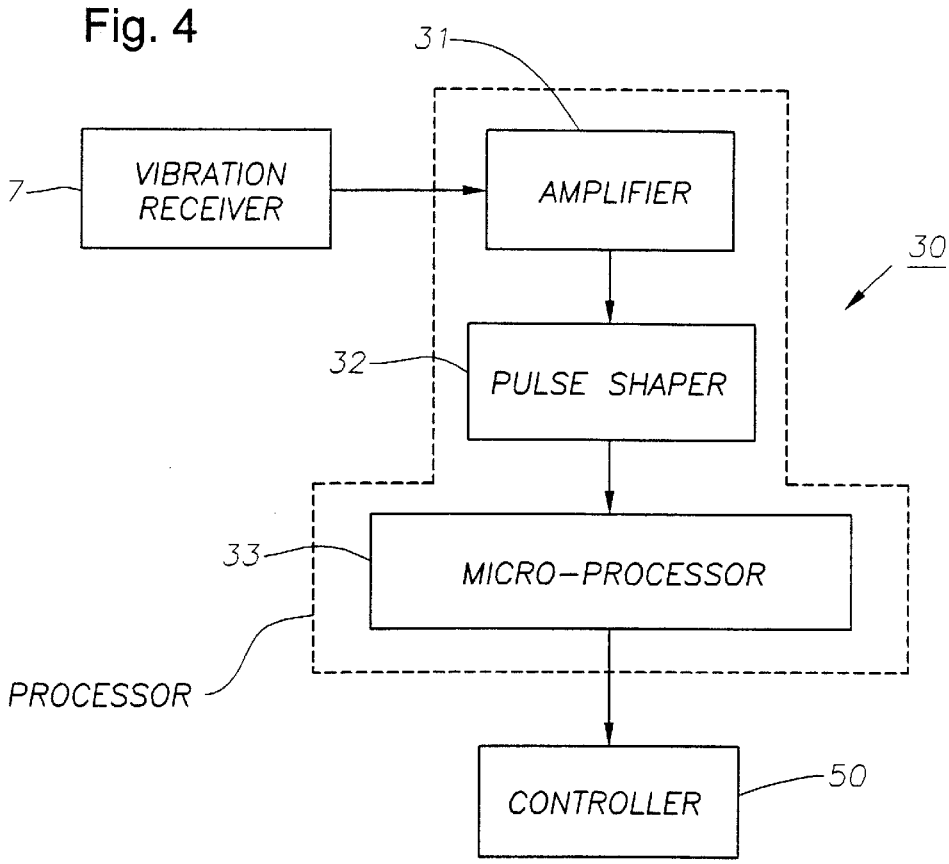
FIG. 4 is a system block diagram for a vibration actuated traffic monitoring system.

In a specific embodiment, an apparatus of the invention includes a device for controlling a traffic light, where the controlling of the traffic light is dependent upon receipt and recognition of vibrations. The device, as depicted in FIGS. 1 and 4, includes vibration receiver 7 for detecting vibrations transmitted through the ground, i.e., "ground waves," a processor 30 for converting one or more of the vibrations into a control signal and a controller 50 to trigger traffic light 10 in response to the control signal. Ground waves are waves which propagate through the ground as a result of mechanical vibrations of the particles forming the ground. Vibration receiver 7, preferably a geophone, may be any device capable of detecting such mechanical vibrations and in turn producing electrical energy or signals corresponding to the vibrations. Further, vibration receiver 7 may be any device capable of detecting mechanical vibrations and transmitting such vibration. In a specific embodiment, vibration receiver 7 detects a pattern of vibrations and produces a pattern of signals corresponding to the pattern of vibrations. The pattern of signals may be in the form of an analog voltage or current where the magnitude of the signal is proportional to displacement caused by the ground vibrations and detected by the vibration receiver 7. Vibration receiver 7 is preferably positioned proximate traffic-bearing surface 1, e.g., partially buried in the ground next to the roadside. Alternatively, the geophone may be attached, via a threaded rod, to a bolt or other connector secured in the traffic-bearing surface; or the geophone may be positioned in the expansion space of the traffic-bearing surface. Vibration receiver 7 may also be part of the processor 30, as shown in FIG. 4, in that it converts detected vibrations into electrical signals. The processor 30 also preferably includes amplifier 31 for strengthening the detected vibration from the vibration receiver, pulse shaper 32, which may comprise a rectifier and/or a digitizer, and microprocessor 33 or, alternatively, an integrated circuit. Further, the device, as depicted in FIG. 1, may also include vibration generator 2, e.g., at least one channel or groove in traffic-bearing surface 1 for generating ground vibrations. Vibration generator 2 preferably facilitates the production of a pattern of ground vibrations when the tire of vehicle 3 passes over the grooves or channels, comprising vibration generator 2.

In another specific embodiment, a method of the invention, as illustrated by FIGS. 1 and 4, includes the steps of detecting vibrations transmitted through the ground, where such vibrations are incited by vehicle 3 passing over vibration generator 2, i.e., one or more grooves formed in traffic-bearing surface 1. Further steps may include converting the vibrations into a control signal and triggering traffic light 10 in response to the control signal. The method may also include the steps of detecting a pattern of vibrations and converting the pattern into a control signal if the pattern matches a reference pattern. The pattern of vibrations may be incited by vehicle 3 passing over a series of grooves in traffic-bearing surface 1, where the series of grooves has a predetermined internal spacing of uniform integral multiple length. For example, if there are three grooves comprising vibration generator 2, each being two inches across, then for the series of grooves to have internal spacing of uniform integral multiple length the first and second grooves and the second and third grooves should be two inches apart or some integer multiple of two inches apart, i.e., four inches, six inches, etc. Thus, for example, in such a series of grooves, if the first and second grooves are four inches apart and the second and third grooves are six inches apart then the reference pattern would be defined as "Groove, 2 Spaces, Groove, 3 Spaces, Groove." The matching would be determined by measuring the time delay between vibrations and comparing the time delays to a calculated uniform delay and the reference pattern as determined by the internal groove spacing. For example, using the reference pattern described above, if the delay between the first vibration and the second vibration was 1.9 milliseconds and the delay between the second vibration and the third vibration was 2.85 milliseconds then the reference pattern would match the delay between pulses because, using the solved for uniform delay of 0.95 milliseconds, the delay pattern of "Vibration, 2 Delays, Vibration, 3 Delays, Vibration," corresponds to the reference pattern of "Groove, 2 Spaces, Groove, 3 Spaces, Groove." Thus, since the vibration pattern and the reference pattern match, the processor 30 will produce a control signal. The pattern of vibrations may also match the reference pattern if the time delays correspond to said uniform delay with respect to the groove spacing within a predetermined variance. For example, using the same pattern as above, if the delay between the first and second vibrations was 1.9 milliseconds and the delay between the second and third vibrations was 2.9 milliseconds, then the reference pattern would not match the delay pattern because the second delay of 2.9 milliseconds is not three times the uniform delay of 0.95 milliseconds. However, if there is a predetermined allowed variance of 0.1 milliseconds, then the reference pattern would match the delay pattern because the second delay of 2.9 milliseconds is equal to three times the uniform delay of 0.95 i.e., 2.85 ms., plus or minus 0.1 ms. Further, the method may also include the step of triggering a traffic light when a pattern of vibrations is detected and converted into a control signal as described above. This control signal is produced when the vibration receiver detects a vibration pattern which matches a preselected reference pattern. The control signal produced by processor 30 activates traffic light 10 to switch from red to green for an approaching vehicle. Of course, such a system would preferably also activate another traffic light to switch from green to yellow, then to red, for intersecting traffic.

In a specific embodiment, the vibration generator 2 comprises at least one channel or groove in traffic-bearing surface 1. Preferably, each of the grooves or channels extends across the traffic-bearing surface substantially perpendicular to the flow of traffic as represented by arrows 5, 6. The number of channels or grooves and the pattern of spacing between channels or grooves may be used to distinguish the vibration pattern, thus fostering lane discrimination and recognition. For example, one lane may have an internal groove spacing pattern of "Groove, 1 Space, Groove, 2 Spaces, Groove, 1 Space, Groove" and another lane could have an internal groove spacing pattern of "Groove, 2 Spaces, Groove, 1 Space, Groove, 2 Spaces, Groove." The specific dimension and geometry of each of the grooves or channels may also be used to generate distinct vibrations to further distinguish vibration patterns and facilitate lane recognition. For example, the device and method may work as described below. A vehicle, traveling toward a traffic intersection passes over a vibration generator consisting of four grooves cut into the traffic-bearing surface. Each groove is positioned perpendicular to the direction of traffic and is two inches across. The first groove is spaced four inches from the second groove, the second groove is spaced two inches from the third groove, and the third groove is spaced four inches from the fourth groove. Thus the reference pattern as determined by the groove spacing is "Groove, 2 Spaces, Groove, 1 Space, Groove, 2 Spaces, Groove." As the tires of the vehicle pass over the first groove a vibration is generated and detected by the vibration receiver positioned proximate the road side. Likewise, vibrations are generated and detected as the tires pass over the second, third and fourth grooves. The detected vibrations are converted into pulses and the time delay between each pulse is measured by the processor. For example, assuming the time delay between the first and second pulses is 11.36 milliseconds, between the second and third pulses is 5.68 milliseconds, and between the third and fourth pulses is 11.36 milliseconds, then the delay pattern and the reference pattern match since the delay between pulses corresponds to the spacing as compared to the uniform delay of 5.68 milliseconds. In other words, the delay pattern, "Pulse, 2 Delays (2×5.68 ms.=11.36 ms.), Pulse, 1 Delay (5.68 ms.), Pulse, 2 Delays (11.36 ms.), Pulse," corresponds to the reference pattern, "Groove, 2 Spaces, Groove, 1 Space, Groove, 2 Spaces, Groove." Thus, the processor 30, having determined that the vibration pattern and the reference pattern are matched, converts the pattern of pulses or signals into a control signal to trigger the traffic light which corresponds to the traffic lane based on the recognized pattern. The traffic light is triggered to switch from illuminating the red light element to illuminating the green light element. The processor also sends control signals to all other lights to change from green, to yellow, then to red or to maintain red.

This embodiment is advantageous in that it can be easily and inexpensively implemented. For example, instead of requiring days of excavation and resurfacing of the traffic-bearing surface to implant a sensor, grooves or channels can be "cut" into the traffic-bearing surface quickly and easily using a conventional concrete cutter. Alternatively, the vibration generator may include raised strips, bumps, or cables stretched perpendicularly across the traffic-bearing surface. The grooves, channels, strips, bumps, or cables may also emanate distinct vibrations recognizable to the geophone according to their number, spacing, geometry, an dimensions. Further, since the vibration receiver is not physically connected to the vibration generator, it can be installed and moved with little expense or difficulty. This is unlike other systems where sensors are imbedded in the traffic-bearing surface, thus requiring expensive and time consuming excavation to salvage monitoring system components or to move the monitoring system to a new location. Further, unlike other systems, repairs of the vibration receiver can be easily performed without tearing up the traffic-bearing surface. Thus, this embodiment is advantageous in that it still maintains the superiority of controlling traffic flow based on the actual traffic in the area and avoids the cost prohibitive, installation, excavation and maintenance of other systems.

Since many traffic intersections already utilize variable timing mechanisms to control traffic lights, these systems could be updated with a specific embodiment of this present invention quickly and for a much more sensible cost then re-furbishing the old system. For example, piezoelectric strips already in place could be used as a vibration generator. A vibration receiver could be placed next to the roadside proximate the piezoelectric strips. The piezoelectric strips could be disconnected from the existing processor and controller and the vibration receiver, connected to its processor, could be interface with the existing controller. Thus the system would be fully operational using the existing piezoelectric strips as a vibration generator and using the existing controller to ultimate trigger the traffic light. Therefore, intersections could be "retro-fitted" using a vibration receiver and a processor preset to recognize vibrations produced by the embedded piezoelectric strips.

Within these above descriptions, a more detailed explanation of a specific embodiment follows. In a specific embodiment, referring to FIG. 1, a vibration generator 2 is located in traffic-bearing surface 1. A vibration generator of this invention broadly includes any component which facilitates the production of vibrations when, preferably, the tire of a motor vehicle 3 passes over vibration generator 2. It is contemplated that a cable stretched across the traffic-bearing surface 1 or a mound of asphalt or cement could serve as a vibration generator. However, preferably, vibration generator 2 is one or more grooves cut into the traffic-bearing surface 1 perpendicular to the flow of traffic as represented by arrows 5, 6.

A vibration receiver 7 is preferably positioned proximate the vibration generator 2 and detects vibrations produced when the tires of vehicle 3 pass over the vibration generator 2. A vibration receiver of this invention broadly includes any device capable of detecting a vibration and producing an electrical signal indicative of the vibration. The preferred vibration receiver is a conventional and commercially available geophone. The vibration receiver 7 may be connected (directly or indirectly) to a processor 30, preferably as shown in FIG. 4. The processor 30 is connected (directly or indirectly) to controller 50. Both the processor 30 and Controller 50 are 25 preferably enclosed in a housing 9.

The vibration receiver 7 should be connected to housing 9 by transmission line 8. The transmission line 8 may be buried in the ground beside traffic-bearing surface 1 to prevent line breaks or cuts. However, the transmission line 8 may also be placed above ground and constructed with a heavy duty rubber cover to equally prevent breaks and cuts. The processor 30 and controller 50 may be connected to traffic light 10 using any conventional connector or transmission cable (not shown).

The vehicle 3, as it passes over the vibration generator 2, causes vibrations which are detected by the vibration receiver 7. Vibration receiver 7 may convert the vibrations into electrical energy which is then transmitted via transmission line 8 to housing 9. Alternatively, vibration receiver 7 may transmit the vibration via transmission line 8 to housing 9 without converting such vibration into electrical energy. In housing 9 the vibration or signal is processed in processor 30 and controller 50 as shown in FIG. 4. The controller 50 sends a control signal to traffic light 10 to activate or deactivate the red light element 11, yellow light element 12, and green light element 13.

Figure 2:
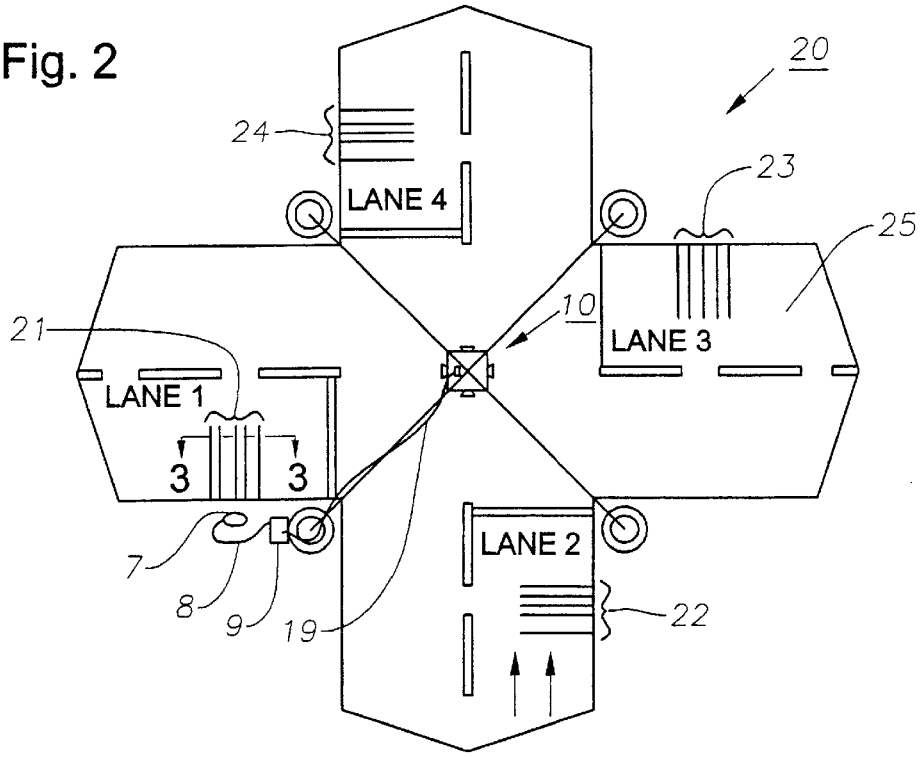
FIG. 2 is a schematic drawing of a traffic intersection showing a traffic light, vibration generators at different traffic lanes, a vibration receiver and a housing for a processor and controller in accordance with a specific embodiment of the invention.
Figure 3:
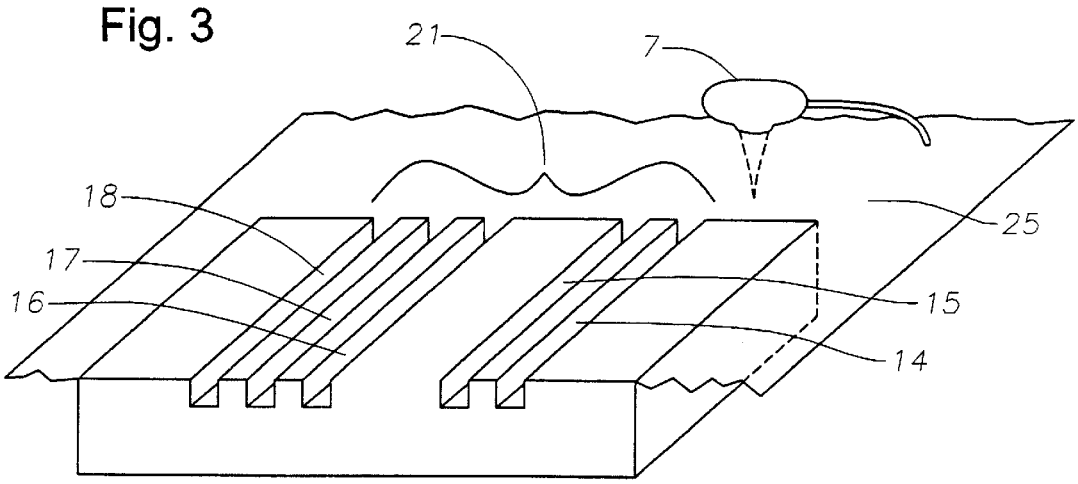
FIG. 3 is a sectional view of one of the vibration generators along line 3—3 in FIG. 2, also showing a geophone.

In another specific embodiment, referring to FIG. 2, a top view of a traffic intersection 20 is shown having four distinct vibration generators 21, 22, 23 and 24. Each vibration generator includes five grooves cut into the traffic-bearing surface and is distinct from the other vibration generators by the internal spacing between grooves. FIG. 3 depicts a cross-sectional view of vibration generator 21 along line 3—3 in FIG. 2 also showing a vibration receiver 7, in particular, a geophone. Grooves 14, 15, 16, 17 and 18 are cut or formed in traffic-bearing surface 25. Each groove 14, 15, 16, 17 and 18 is two inches deep and two inches across. Grooves 14 and 15 are two inches apart. Thus, there is one space between grooves 14 and 15. A space is determined by the dimensions of the grooves. Since each groove is two inches across, then one space is equal to two inches or, in other words, that space which could accommodate one groove. Thus the groove pattern for vibration generator 21 is "Groove 14, 1 Space, Groove 15, 3 Spaces, Groove 16, 1 Space, Groove 17, 1 Space, Groove 18." This internal spacing will facilitate lane discrimination and provide more accurate control of traffic light 10. For instance, if a vehicle were to pass over vibration generator 21 producing five vibration as its tire strikes the grooves then the processor 30 and controller 50 can recognize the vibration pattern and correlate the lane and vibration generator from which the vibrations are generated iby measuring the delay times between vibrations. For example, if the vibration receiver 7 detects "Vibration, Delay, Vibration, 3 Delays, Vibration, Delay, Vibration, Delay, Vibration" then the processor can match this pattern to the groove pattern of vibration generator 21 and initiate a control signal with respect to lane 1. But if the vibration receiver 7 detects "Vibration, 2 Delays, Vibration, Delay, Vibration, Delay, Vibration, 2 Delays, Vibration" then the processor would match this pattern to the groove pattern of vibration generator 24 and initiate a control signal with respect to lane 4. The vibration receiver 7 can detect vibrations from all vibration generators 21, 22, 23, and 24 and control the traffic light 10 for the appropriate lane depending on the vibration pattern detected and the predetermined groove pattern. Like FIG. 1, FIG. 2 also shows vibration receiver 7 connected to housing 9 by transmission line 8. FIG. 2, however, also shows housing 9, which encloses the processor 30 and controller 50 of FIG. 4, connected to traffic light 10 by transmission line 19. Transmission line 19 may be of similar construction to transmission line 8.

Turning now to FIG. 4, the connections between the vibration receiver 7, processor 30, and controller 50 are shown in block diagram form. The processor 30 preferably includes amplifier 31, pulse shaper 32 and microprocessor 33. The vibration receiver 7 may be part of the processor 30. Further, the controller 50 may also be part of the processor 30. The vibration receiver 7 detects vibrations and preferably converts the detected vibration into an electrical signal. The signal is transmitted from the vibration receiver 7 to the amplifier 31. The amplifier 31 produces an electrical output that has an increased magnitude so as to facilitate detection and processing without compromising the inherent characteristics of the unamplified signal. In other words, the amplifier 31 strengthens the electrical signal indicative of the detected vibration. The amplified signal is then transmitted to pulse shaper 32. The pulse shaper 32 may be any device or circuit capable of altering the characteristics of a signal. For example, the pulse shaper 32 may be a rectifier and/or a digitizer. The pulse shaper 32 alters the characteristics of the amplified signal so that it is recognizable to the microprocessor 33. Alternatively, an application specific integrated circuit, ASIC, or any other integrated circuit may replace the microprocessor 33. Related to FIG. 4, FIG. 5 shows the components of the processor in accordance with a specific embodiment.

Figure 5:
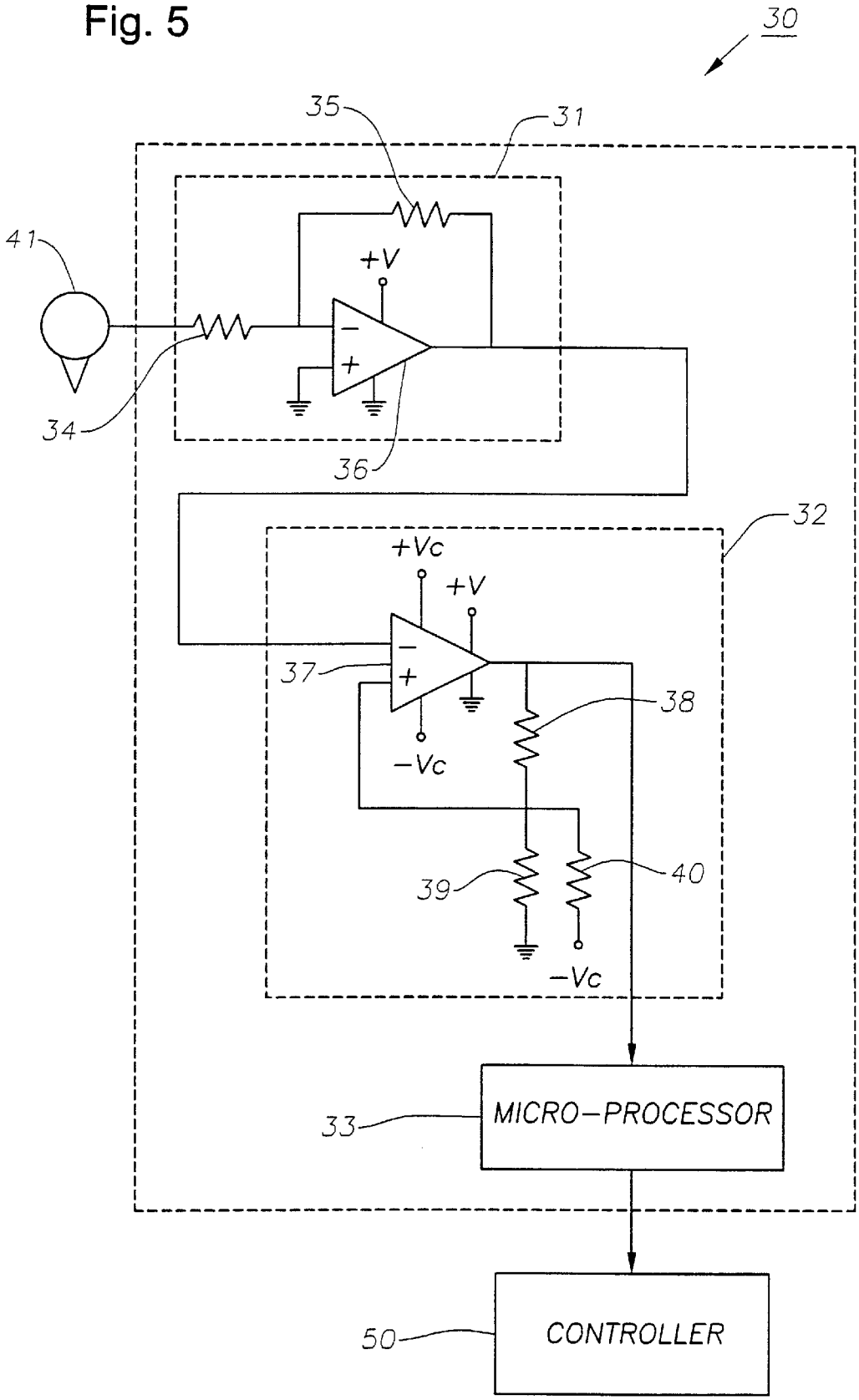
FIG. 5 is a logic block diagram for a processor in accordance with a specific embodiment of the invention.

Turning to FIG. 5, components are shown which may compromise one example of the vibration receiver 7, and the processor 30 as shown in FIG. 4. The vibration receiver 7 of FIG. 4 may compromise a geophone 41 as depicted in FIG. 5. Geophone 41 is connected to amplifier 31 which may be implemented through the use of a conventional operational amplifier 36, resistor 34 and feedback resistor 35. The gain of the amplifier is equal to the ratio of resistor 34 to resistor 35. The output from amplifier 31 is supplied to wave shaper 32 which is designed to shape the amplified waveform into a signal which is recognizable to microprocessor 33. One example of a wave shaper 32 may be a typical Schmitt trigger implemented through the use of an operational amplifier 37, and resistor network using appropriate resistors 38, 39, and 40 to produce the signal input to microprocessor 33. The implementation of microprocessor 33, as part of processor 30, is described below with reference to FIG. 6. Alternatively, the wave shaper 32 may be a conventional analog-to-digital converter thus requiring a different microprocessor implementation (not shown). The output of the microprocessor 33 is supplied to controller 50, which may be a standard controller as used in conventional traffic light controls. The microprocessor 33 may be implemented so as to process the vibrations and simulate the "call signals" of existing controllers, thus facilitating an easy and inexpensive retro-fit for intersections.

Figure 6B:
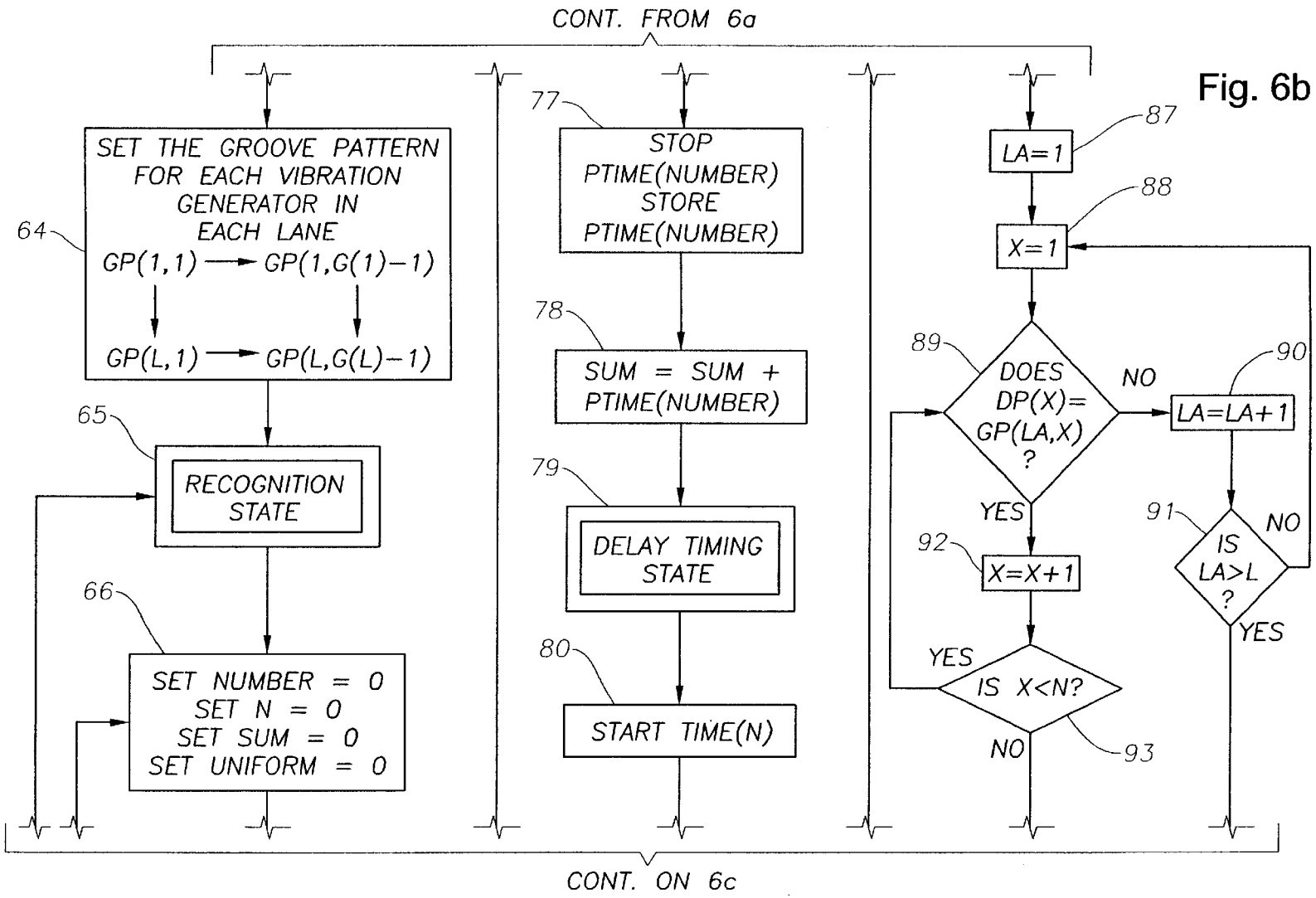
FIGS. 6*a,* 6*b,* and 6*c* are a flow chart showing vibration pattern detection in accordance with a specific embodiment of the invention.
Figure 6C:
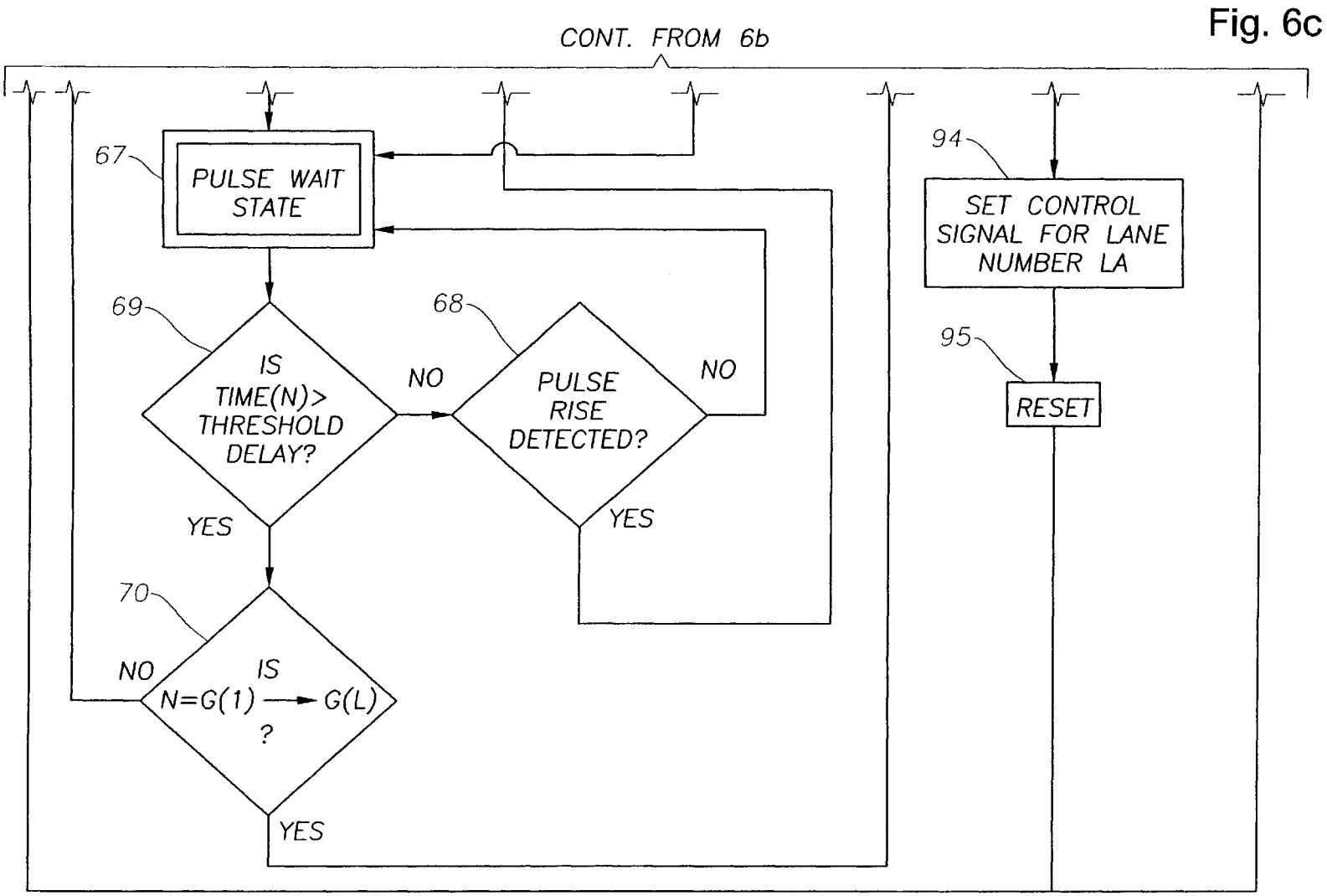

The processor 30 or the microprocessor 33, as part of processor 30, may support a programmed control procedure as discussed below and as shown in FIG. 6. The flow chart in FIG. 6 shows one of the many possible methods which may be programmed into the processor 30 or microprocessor 33, e.g., in the form of an algorithm, to further process the signals transmitted from the vibration receiver. As will be recognized by persons skilled in the art, the methods shown in FIG. 6 may be implemented using conventional programming techniques.

Referring now to FIG. 6, the method may be implemented in a state machine or in software that simulates a state machine as described below. Each main state is identified by a bordered rectangle; substates of the main states are identified by a hashed bordered rectangle; decisions and conditions are identified by diamonds; and events and actions are identified by borderless rectangles. For convenience, the method shown in FIG. 6 will also be described with reference to a vehicle's interaction with a vibration actuated system exemplified in FIG. 7.

Figure 7:
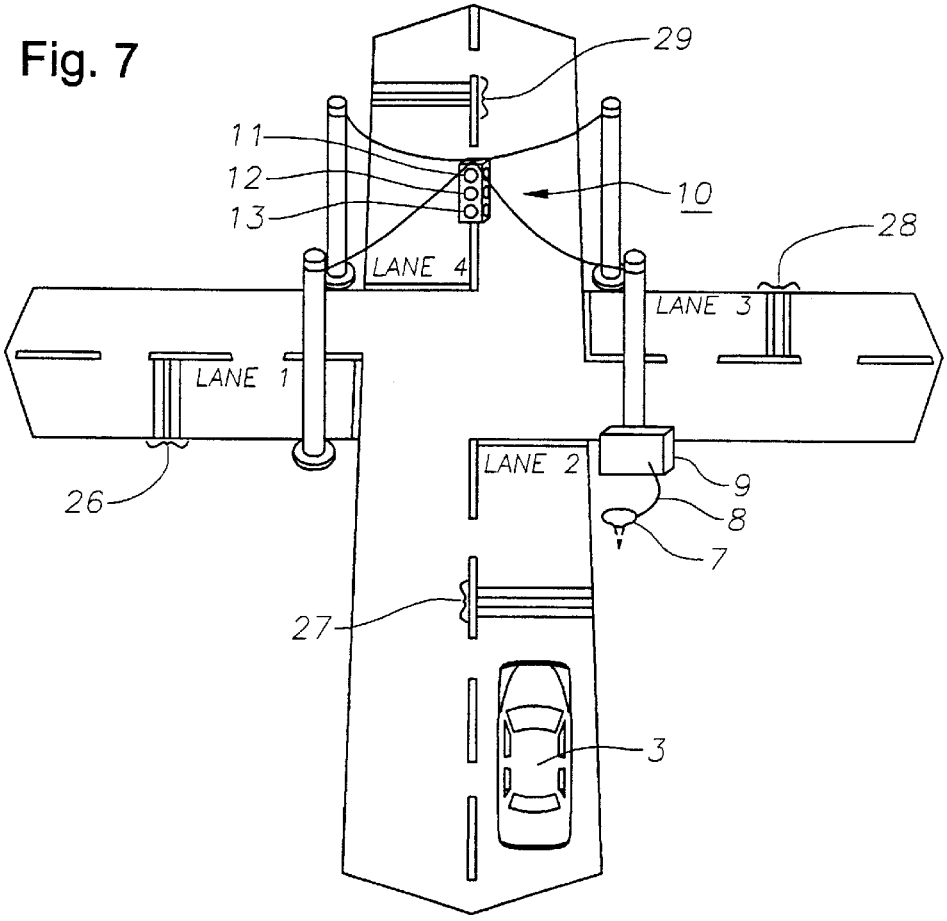
FIG. 7 is a schematic drawing of a traffic-bearing surface showing a vehicle interacting with a vibration generator, a vibration receiver, a housing for a processor and controller, and a traffic light in accordance with another specific embodiment of the invention.

The state machine as depicted in FIG. 6 consists of three Main States: the initialization state 60, recognition state 65, and delay pattern state 81. The Main State 65, recognition state, consists of four substates; the pulse wait state 67, timing state 71, pulse timing state 75 and delay timing state 79. In Event 61, as part of the Main State 60, initialization state, the processor 30 or microprocessor 33 is first loaded with a threshold delay. The threshold delay may be calculated from the maximum time it would take a vehicle to pass over a vibration generator going at a minimum speed. The threshold delay may also be calculated based on the average size of a vehicle and the speed limit of the road upon which the vibration generator is positioned. The processor 30 or microprocessor 33 algorithm may include steps (not shown) where, upon the entering of a speed limit or other predetermined variables, the processor will calculate the threshold delay. In Event 62 of initialization state 60, the variable L is set to equal to the number of lanes containing a vibration generator. In Event 63 the variables G(1) through G(L) are set to equal to the number of grooves comprising the vibration generator within the particular lane. For example, in FIG. 7 there are four lanes with vibration generators. Therefore, L, in Event 62, would equal 4, and the variables G(1), G(2), G(3) and G(4), in Event 63, would be set to 4, relating to the number of grooves comprising vibration generators 26, 27, 28, and 29, respectively as depicted in FIG. 7. Although, in this example, the number of grooves comprising each vibration generator in each lane are equal, the number of grooves may vary. For example, Lane 1 could have a vibration generator with 3 grooves or Lane 3 could have a vibration generator with 5 grooves.

In Event 64 the variable matrix GP(L, G(L)−1) is loaded with a value corresponding to the internal spacing of the grooves of each vibration generator in each lane as set previously by variable L. For instance, vibration generator 26 as depicted in FIG. 7 has an internal spacing or groove pattern of "Groove, 2 Spaces, Groove, 1 Space, Groove, 2 Spaces, Groove." Likewise, vibration generator 27 has an internal spacing or groove pattern of "Groove, 1 Space, Groove, 1 Space, Groove, 1 Space, Groove." Therefore, the spacing numbers are inserted into the variable matrix as described above in Event 64. For instance, the vairable GP(1,1), representing the groove spacing pattern for lane 1, first groove space, would be 2. Likewise varaible GP(1,2) would be 1 and GP(1,3) would be 2. Similarly, variable GP(2,1), representing the groove spacing pattern for lane 2, first groove space would be 1 and GP(2,2) and GP(2,3) would also be 1. The spacing values would also be entered for the remaining two lanes, lane 3 and lane 4 corresponding to vibration generator 28 and 29 respectively. Once the variable matrix is filled corresponding to the traffic intersection then Main State 60, initialization state, is complete and execution passes to Main State 65, recognition state.

Recognition state 65 begins by setting all disposable variables to zero as depicted in Event 66. For example, NUMBER equals zero, N equals zero, SUM equals zero and UNIFORM equals zero. These variables are used in the calculating and sorting of the pulses, times, and delays. Substate 67, pulse wait state, then begins. Pulse wait state 67 awaits for a pulse, representing a processed vibration, to be detected by the processor 30. The pulse is detected when the rising edge of a pulse is observed as shown in decision 68. First, TIME (N) is compared against the threshold delay as previously set in Event 61. If TIME (N) is less than or equal to the threshold delay, then execution passes to decision 68 where the processor determines if a rising edge of a pulse has been detected. If no rising edge is detected, the execution passes back to Substate 67, Pulse Wait State. If a pulse rise is detected the execution passes to Substate 71, timing state. If in decision 69, TIME (N) is greater than the threshold delay, then the procedure steps to decision 70. Decision 70 determines if the variable N is equal to the number of lanes as set in Event 63 and as stored in variables G(1) through G(L). If the variable N is equal to the number of grooves in one of the lanes of the intersection, then the execution of the state machine passes to Main State 81, Delay Pattern state.

Within Substate 71, in Event 72, the timer is stopped and a value from the timer is stored in the variable TIME (N).

Next, the variables N and NUMBER are increased by 1 as shown in Event 73. Execution then passes to Event 74 to start the timer as represented by variable PTIME (NUMBER). The ultimate value of variable PTIME (NUMBER) will represent the traverse time of a detected pulse, i.e., the time elapsed from pulse rise to pulse fall. In Substate 75, pulse timing state, the timer counts until a pulse fall is detected as shown in Decision 76. If no pulse fall is detected, then the timer as represented by PTIME (NUMBER) continues to increase. Execution continues in a loop between Substate 75, Pulse Timing State, and decision 76 until a pulse fall is detected in decision 76. Upon detection of a pulse fall execution steps to Event 77 where the timer is stopped and a value for the time is stored in the variable PTIME (NUMBER). As stated above, this number represents the traverse time of the pulse. Execution then steps to Event 78 where the current value of the variable SUM is added to the value of PTIME (NUMBER). This sum will be used to ultimately determine the uniform delay in Event 82. Execution then passes to Substate 79, delay timing state. Since a pulse fall was detected, the delay between pulses can now be measured. In Event 80, the timer is started as represented by variable TIME (N). Execution then passes back to Substate 67, pulse wait state, where timer continues to count until a pulse rise is detected as depicted in Decision 68. First, the value for TIME (N) is compared to the value for the threshold delay in Decision 69. If TIME (N) is not greater than the threshold delay, the execution passes to decision 68 where the processor determines if a new pulse has been detected, i.e., a pulse rise has been observed. If no pulse rise is detected then execution passes back to Substate 67, pulse wait state, and the timer is continued to be incremented. Execution again passes to decision 69 where the timer value, TIME (N), is again compared to the threshold delay. This loop will continue until either the value for TIME (N) is greater than the threshold delay or a pulse rise is detected in decision 68. If a pulse rise is detected the execution passes to Substate 71, timing state, where the timer will be stopped and a value for the timer will be stored in variable TIME (N) as shown in Event 72. However, if in decision 69, the timer value for TIME (N) is greater than the threshold delay, then execution advances to decision 70 where the variable N is compared to the number of grooves in each lane as set in variables G(1) through G(L). If the variable N equals to the number of grooves in one of the lanes, then execution advances to Main State 81, delayed pattern state. If not, then execution passes back to Main State 65, recognition state, where the variables NUMBER, N, SUM, and UNIFORM, are reset to zero in Event 66.

This procedure will continue until the condition in 69, that being, the value for the variable TIME (N) is greater than the threshold delay and the condition in 70 that being that the variable N is equal to the number of grooves in one of the lanes are both met. Upon meeting these conditions, execution will pass to Main State 81, delay pattern state. In this state, the uniform delay is calculated and the delay pattern is calculated. First, in Event 82 the variable UNIFORM is set to equal to the variable SUM divided by the variable N. SUM is the summation of all the pulse times as determined in recognition state 65. Event 83 sets a variable Y to a value of 1. In Event 84 the delay pattern is calculated using variable DP(N−(N−Y)). The delay pattern is equal to the TIME (Y) divided by the variable UNIFORM as calculated in Event 82. Upon calculating the delay pattern variable, execution passes to Event 85 where the variable Y is incremented by 1. In decision 86, Y is compared to the variable N and if Y is less than N, then a delay pattern for the next variable is calculated. If Y is greater than or equal to N, then execution passes to Event 87. If execution does pass to Event 87 then a complete delay pattern has been processed.

In Event 87 the variable LA is set to equal 1. In Event 88 the variable X is set to equal to 1. The variable LA represents the lane number and the variable X corresponds to the delay pattern number. In Decision 89, the delay pattern value is compared to the groove pattern value. As shown by formula DP(X)=GP(LA,X). If the delay pattern corresponding to the groove number does not match the groove pattern for that groove number, then execution passes to Event 90 where LA is incremented by 1 therefore proceeding to data stored for another lane. LA is then compared to a variable L as set in the initialization state 60. If LA is greater than L, the number of lanes has been exceeded and execution passes back to recognition state 65 where pulses in a new delay pattern are detected. If Decision 91 is met, then no control signal is produced as the delay pattern and the groove pattern do not correspond or match. However, if the variable LA is less than or equal to the number of lanes having a vibration generator, then execution passes back to Event 88 where X is reset to 1. Action then again passes to Decision 89 where the delay pattern and the groove pattern are matched. If the delay pattern and the groove pattern do match, then execution passes to Event 92 where the delay number is increased by 1 as shown by the formula X=X+1. X is then compared to the variable N. If X is less than N, then the execution passes back to Decision 89 where the next delay pattern is compared to its corresponding groove pattern. However, if in Decision 93 X is not less than N, then the complete delay pattern and groove patter have been matched and execution steps to Event 94 where a control signal is set for the lane corresponding to the variable LA. After the control signal is set and sent, execution passes to Event 95 which resets all variables and returns to recognition state 65.

The procedure as described in FIG. 6 will be further detailed with reference to vehicle 3 interacting with the system as shown in FIG. 7. First, in Event 61, the threshold delay will be set to a predetermined 20 ms. In Event 62 the variable L will equal to 4 since the number of lanes with vibration generators is 4. The variables G(l) through G(L), in Event 63, will be set to the number of grooves corresponding to the lane number in which the vibration generator is positioned. Thus, G(1) is 4, G(2) is 4, G(3) is 4, and G(4) is 4. In Event 64 the groove spacing value according groove pattern for each vibration generator in each lane is loaded into the variable matrix GP(L,G(L)−1). Thus, for the intersection as depicted in FIG. 7 with vibration generator 26, 27, 28, and 29, the matrix would consist of the values as follows:

GP(1,1)=2 GP(1,2)=1 GP(1,3)=2
GP(2,1)=1 GP(2,1)=1 GP(2,3)=1
GP(3,1)=1 GP(3,2)=2 GP(3,3)=1
GP(4,1)=2 GP(4,2)=1 GP(4,3)=1

Execution would then pass to Main State 65, recognition state, where, as shown in Event 66, the variables NUMBER, N, SUM, UNIFORM are set to 0. Action then proceeds to Substate 67, pulse wait state, where upon vehicle 3 crossing the first groove of vibration generator 27 a vibration is produced which is converted into a pulse subsequently transmitted to the processor. Since the variable TIME (N=0)=0 and is not greater than the threshold delay as shown in Decision 69, execution passes to decision 68. Since a pulse has been detected, execution will pass to Substate 71, timing state. In Event 72 the variable TIME (N) has a value of 0 because the timer had not been started and thus there is no value of the timer to be stored in the variable. In Event 73, N is incremented by 1 therefore equaling 1. NUMBER likewise, is incremented by 1 therefore equaling 1. Since a pulse was detected, the timer represented by PTIME (NUMBER) is started. Execution then advances to Substate 75 where the pulse time is measured. In decision 76 the timer is incremented until a pulse fall is detected. 3 ms. after timer was started, a pulse fall is detected. Thus, the timer is stopped at 3 ms. and the value of 3 ms. is stored in the variable PTIME (1). In Event 78, the variable SUM is calculated by the formula SUM=SUM+PTIME (1). Thus, SUM=0+3 ms.=3 ms. Execution then passes to Substate 79, delayed timing state. Since the end of the pulse has been detected, the timer is started and execution passes back to Substate 67, pulse wait state, where the start of another pulse is awaited. While waiting for the next pulse, the timer is incremented. In decision 69, the timer value as represented by the varaible TIME (1) is compared to the threshold delay. At this point, TIME (1) has a value of 2 ms. which is less than the threshold delay of 20 ms., so execution passes to decision 68 where the processor determines if a pulse rise has occurred. Since, a pulse rise has not yet occurred, execution passes back to Substate 67. Again, the value for the timer as represented by the variable TIME (1) is compared to the threshold delay, and since the current value of TIME (1) is 3 ms., less than 20 ms., execution again passes to decision 68. By now another pulse rise has occurred and thus the condition in decision 68 is met causing execution to pass to Substate 71, timing state. The timer is stopped and the time of 3 ms. is stored in variable TIME (1). N is then incremented by 1, therefore producing N=2. Likewise, NUMBER is incremented by 1 therefore producing NUMBER=2 as shown by the equations in Event 73. Again, since a pulse has been detected, Event 74 starts the timer and advances execution to Substate 75 so the pulse time may be calculated. Upon detection of a end of the pulse as in decision 76, the timer is stopped by Event 77 and the time is stored as variable PTIME (2). This value is equal to 3 ms. In Event 78, SUM, which has a current value of 3 ms., is added to PTIME (2). Thus, SUM's new value is 6 ms. Action then passes to Substate 79, delay timing state. Since the end of a pulse has been detected the timer will start and continue to be incremented until the beginning of the next pulse is observed, assuming that the increasing value of TIME (2) is not greater than the threshold delay. 3 ms. later a new pulse is detected and thus execution steps to Substate 71 where the value of the timer is stored in variable TIME (2) as 3 ms. Action then passes to Event 73 where the variable N is incremented by 1 thus equaling 3 and the variable NUMBER is incremented by 1 thus equaling 3. Once again, since a new pulse has been detected, the timer will start and upon detection of the end of the pulse the timer will be stopped as shown in Decision 77. The variable TIME (3) is then stored as 3 ms., i.e., the time elapsed since the beginning of the pulse and the end of the pulse. SUM which has a current value of 6 ms. is then added to the variable PTIME (3) which has a value of 3 ms. Thus, the new value of SUM is 9 ms. Action then passes to Substate 79, delay timing state. Again, since the end of a pulse has been detected, the delay between pulses is timed once again. 3 ms. elapses between the end of the pulse and the beginning of the new pulse. Thus, in decision 69 the TIME (3) is less than the threshold delay of 20 ms. so execution passes to decision 68. Since a new pulse has been detected, execution once again passes to Substate 71, timing state. The timer is stopped and the time value is stored in variable TIME (3). The variable N is then incremented again to the new value of 4, and the variable NUMBER is also incremented to 4. Once again, in Event 77, since a new pulse has been detected, the timer will start and upon detection of the end of the pulse, the timer will be stopped. The value of the timer (3 ms.) is stored in the variable PTIME (4). In Event 78, SUM, having a current value of 9 ms., is added to the variable PTIME (4) which has a value of 3 ms. Therefore, the new value of SUM is 12 ms. Action then passes to Substate 79, delay timing state. Since the end of a pulse has been detected once again, the time between pulses will be measured as execution is passed to Substate 67, pulse wait state. In this instance another pulse is not detected and 21 ms. passes. Execution passes to Decision 69 where TIME (4) with a current value of 21 ms. is compared to the threshold delay. Since 21 ms. is greater than the threshold delay of 20 ms., execution passes to Decision 70 where the current value of N is compared to G(1), G(2), G(3), or G(4). Since the current value of N which is 4, is equal to at least one of the variables G(1), G(2), G(3), or G(4), execution passes to Main State 81, delay pattern state.

In Main State 81, the variable UNIFORM is calculated by dividing the current value of SUM by the current value of N. UNIFORM in this case would be equal to 12 ms.÷4 which equals to 3. Execution then passes to Event 83 where Y is set to 1. In Event 84 the delay pattern is set by the equation DP(N−(N−Y)=TIME (Y)+UNIFORM. In this instance DP (4−(4−1))=TIME (1)+UNIFORM, which simplifies to DP(1)=3÷3=1. Thus, in Event 84, DP(1)=1. Action then passes to Event 85 where Y is incremented by 1 and thus equals to 2. In Decision 86 Y is compared to the current value of N which is 4 and it is determined that Y is less than 4 thus action passes back to Event 84 where the next delay pattern is calculated. The delay pattern is represented by DP(4−(4−2))=TIME (2)÷UNIFORM, which simplifies to DP(2)=1. Once again, in Event 85 Y is incremented to 3 and since Y is less than 4 as in decision 86 the next delay pattern is calculated, that being DP(3)=1. Again, in Event 85 Y is incremented to 4. In decision 86, Y is not less than 4 therefore action passes to Event 87 where the variable LA is set to 1 and then to Event 88 where variable X is set to 1. In Decision 89 the delay pattern value previously calculated in Event 84 and stored in the variable DP(N−(N−Y) is compared to the groove pattern value as stored in the variable matrix GP(L,G(L)−1). Thus, the processor decides if DP(X) equals GP(LA,X). The first value DP(X) which has a value of 1 is compared to GP(LA,X) which corresponds to the value stored in GP(1,1) having a value of 2. Therefore, DP(1) does not equal to GP(1,1) so action passes to Event 90 where the variable LA is incremented by 1 to equal to the value of 2. Execution is then passed to decision 91 where LA is compared to the variable L previously set in Event 62 equaling to 4. Since LA with a value of 2 is not greater than L, execution is passed back to Event 88 where X is reset to 1. Then, DP(X) being DP(1) is compared to GP(LA,X) corresponding to the value stored in GP(2,1) having a value of 1. Thus DP(1) with a value of 1 equals GP(2,1) and execution is passed to Event 92 where X is incremented by 1 to equal the value of 2. In Decision 93, X is then compared to the current value of N which is 4 and determined that it is less than 4. Thus, execution passes back to decision 89 where the next delay pattern is calculated. DP(2) being 1 is compared to GP(2,2) which also has a value of 1 and thus Decision 89 is met. Once again in Event 92, X is incremented by 1 thus equaling the value of 3 and is compared to the current value of N being 4. In Decision 93, since X is less than 4, the action is again passed to Decision 89 where the next delay pattern is compared to the corresponding groove pattern. Since DP(3) having a value of 1 is equal to GP(2,3) which has a value of 1, execution is again passed to Event 92 where X is incremented by 1, thus equaling 4. However, in Decision 93 this time, X is not less than N and therefore, execution is passed to Event 94 where a control signal is set for the lane number LA which has a value of 2. Thus, the groove pattern has been matched to the delay pattern and the control signal can be sent to activate the traffic signal 10 for lane 2. Action is then passed to Event 95, where all variables are reset. Execution finally passes back to Main State 65, recognition state, where the process begins again.

In another specific embodiment, the processor 30 or the microprocessor 33 may be implemented with several independent state machines as shown and described in FIG. 6. In this embodiment, each detected vibration, i.e., pulse, is processed and activates a separate state machine within the microprocessor 33. Each state machine could result in either a valid matched vibration pattern or an invalid vibration pattern using similar steps as described in FIG. 6. For example, if a string of six vibrations were detected, then each of the six vibrations would start its own individual state machine where the vibration and it subsequent vibrations would be processed in the microprocessor 33 to determined if that series of vibration, i.e., the vibration pattern, matched the reference pattern as described in FIG. 6. This implementation prevents missing a valid and matched vibration pattern if some of the vibrations are falsely detected vibrations.

As discussed above, traffic monitoring systems are used for operating traffic lights to control traffic flow, detecting speed violations and ascertaining red-light violations. However, some systems can also be used to reduce traffic accidents and to generate "fine" revenue that may be used to pay for the cost of installing and maintaining the systems.

Accordingly, in yet another embodiment of that invention, the pattern of vibrations generated by the vibration generator may activate a system to count the number of vehicles traveling a route, or to open a gate, e.g., an entrance gate to an enclosure. Although not specifically mentioned, the vibration actuated traffic monitoring system may control numerous other peripheral devices and may operate under many other uses. In yet another specific embodiment of the invention, the traffic monitoring system activates a camera to capture the image of a passing vehicle. A pattern of subsurface vibrations is produced when a vehicle passes over the vibration generator, e.g., a groove, channel, strip, or bump, which is preferably positioned perpendicular to the traffic-bearing surface. A vibration receiver, preferably a geophone, converts the pattern of vibrations into a pattern of signals corresponding to the vibration. A processor transforms the pattern of signals into a control signal to control the camera. The control signal enables the camera to capture an image of a vehicle when the vehicle "runs" a red light, or exceeds the speed limit. Such camera systems are disclosed in co-pending applications, Ser. Nos. 08/685,785, 08/252,182, 08/730736, 08/693,509, 08/561,077 and 08/688,832, hereby incorporated by reference to the extent not inconsistent with the present invention.

In another specific embodiment, a method of the invention includes a device for vehicle classification, where the classification is dependent upon receipt and recognition of a pattern of vibrations. The device includes a vibration receiver for detecting a pattern of vibrations transmitted through the ground and a processor to convert the pattern of vibrations into a usable signal. The device may also include a vibration generator which preferably facilitates the production of the pattern of vibrations. This vehicle classification device may be used for traffic management, including, for example, counting vehicles to determine when a parking lot is full, or classifying vehicles as to the number of axles and thus, quickly enabling toll calculations at toll booths. Still further, this device may be used to calculate the speed of vehicles regardless of the number of axles on the vehicle. It is understood that this invention is not limited to these specific examples, embodiments, and uses described herein. Many modifications, improvements, and other uses, may be made without departing from the scope of the invention.

Figure 8:
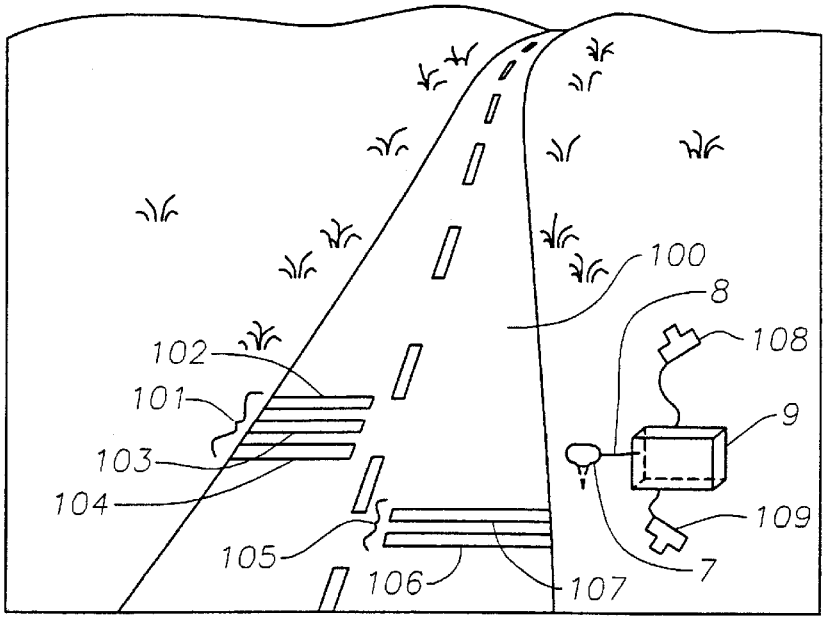
FIG. 8 is a schematic drawing of a traffic-bearing surface showing multiple vibration generators, a vibration receiver, and a housing for a processor and controller in accordance with another specific embodiment of the invention.

Turning now to FIG. 8, another specific embodiment is shown as depicted by the schematic showing a traffic-bearing surface 100 with grooves 102, 103, and 104 therein comprising vibration generator 101 and grooves 106 and 107 comprising vibration generator 105. Vibration receiver 7 is positioned proximate the traffic bearing surface 100 and the vibration generators 101 and 105. Vibration receiver 7 is connected to housing 9 by transmission line 8. Housing 9 encloses the processor 30 and controller 50 as shown, for example, in FIGS. 4 and 5. Housing 9 is connected to cameras 108 and 109. The cameras 108 and 109 may be used to capture a picture of a speeding vehicle. The cameras 108 and 109 may be conventional photographic cameras or digital image cameras. In this embodiment, the determination of a vehicle crossing the vibration generators 101 and 105 may be determined in the same manner as described in FIG. 6. Additionally, the speed of the vehicle may be determined by using the delay between pulses and the distance between grooves comprising the vibration generator. The cameras 108 and 109 could be triggered to take a picture of a vehicle upon detection and verification that the vibration pattern matches the reference pattern and that the vehicles speed is greater than the speed limit allowed on the particular road. Like in FIG. 6, where the processor 30 or microprocessor 33 determines the delay pattern and compares it to the reference pattern in search of a match, the processor 30 could also determine the speed based on the time between vibrations or pulses and the distance between grooves. The processor 30, upon confirmation of a vehicle speeding could produce a control signal which would be sent to the controller 50 in order to trigger cameras 108 and 109. The speed as calculated by the processor 30 could be used to trigger cameras 108 and 109 at a time so as to capture the violators license plate.

This basic structure, function and design as described above, may be put to numerous other uses. For example, a traffic-bearing surface may have a vibration generator consisting of only one groove. A vibration receiver may detect vibrations incited by a vehicle passing over such groove and convert the vibration into a control signal or other signal which operates a counter so as to accurately count the number of vehicle traveling on the road. Further, the same design could be used to open a gate or door.

What is claimed is:

1. A method of monitoring moving vehicles, the method comprising:

detecting vibrations transmitted through the ground, wherein the vibrations are incited by a vehicle passing over a vibration generator;

determining whether a speed of the vehicle exceeds a speed limit based on the detected vibrations; and triggering a camera to capture an image of the vehicle if the vehicle exceeds the speed limit wherein the vibration generator incites a pattern of vibrations which triggers a control signal if the pattern of vibrations matches a reference pattern.

2. A method of monitoring moving vehicles, the method comprising:

detecting a pattern of vibrations transmitted through the ground, the vibrations incited by a vehicle passing over one or more grooves formed in a traffic-bearing surface;

producing a pattern of signals corresponding to the pattern of vibrations;

comparing the pattern of signals to a reference pattern;

converting the pattern of signals into a control signal if the pattern of signals matches the reference pattern;

determining whether a speed of the vehicle exceeds a speed limit based on the detected vibrations; and triggering a camera in response to the control signal and the determination of whether the vehicle exceeds the speed limit to capture an image of the vehicle.

3. The method of claim 2, wherein the grooves are internally spaced by a uniform integral multiple length of the grooves.

4. The method of claim 2, wherein the pattern of signals matches the reference pattern if a time delay between signals with respect to the internal spacing of the grooves corresponds to a uniform delay.

5. The method of claim 4, wherein the pattern of signals matches the reference pattern if the time delay corresponds to the uniform delay within a predetermined variance.

6. The method of claim 2 further comprising:

converting each vibration of the pattern of vibrations into an electrical signal;

amplifying the electrical signals; and digitizing the amplified signals.

7. The method of claim 6, wherein the electrical signal is an analog voltage waveform having a magnitude proportional to a displacement produced by said vibrations.

8. A method of monitoring moving vehicles, the method comprising:

detecting vibrations transmitted through the ground, wherein the vibrations are incited by a vehicle passing over a vibration generator; determining whether a vehicle travels into an intersection in violation of a traffic signal; and triggering a camera to capture an image of the vehicle if the vehicle violates a traffic signal wherein the vibration generator incites a pattern of vibrations which triggers a control signal if the pattern of vibrations matches a reference pattern.

9. An apparatus for monitoring moving vehicles comprising:

a vibration generator extending across a traffic-bearing surface for generating a pattern of vibrations;

a vibration receiver for detecting the pattern of vibrations incited by a vehicle passing over the vibration generator;

a processor for converting the pattern of vibrations into a control signal and for producing a violation signal when a speed of a vehicle exceeds a speed limit; and a controller to trigger a camera in response to the violation signal.

10. The apparatus for monitoring moving vehicles of claim 9, wherein the vibration generator comprises a series of one or more grooves in a traffic-bearing surface proximate a traffic intersection having a predetermined internal spacing of uniform integral multiple length.

11. The apparatus for monitoring moving vehicles of claim 9, wherein the vibration receiver converts the pattern of vibrations into a pattern of electrical signals.

12. The apparatus for monitoring moving vehicles of claim 11, wherein the processor converts the pattern of electrical signals into a control signal if a time delay between electrical signals corresponds to a uniform delay within a predetermined variance.

13. An apparatus for monitoring moving vehicles, comprising:

a geophone capable of detecting a pattern of vibrations and producing a pattern of signals corresponding to the pattern of vibrations;

a processor to convert the pattern of signals into a control signal and for producing a violation signal when a vehicle traverses an intersection in violation of a traffic signal; and a controller to trigger a camera in response to the violation signal.

14. The apparatus for monitoring moving vehicles of claim 13, additionally comprising a vibration generator for generating the pattern of vibrations.

15. The apparatus for monitoring moving vehicles of claim 13, wherein the vibration generator comprises a series of one or more grooves in a traffic-bearing surface proximate a traffic intersection having a predetermined internal spacing of uniform integral multiple length.

16. An apparatus for monitoring moving vehicles, comprising:

a traffic-bearing surface proximate a traffic intersection, the surface having a predetermined number of grooves to produce a pattern of vibrations;

a geophone positioned proximate the traffic-bearing surface, wherein the geophone is capable of detecting the pattern of vibrations incited by the grooves and producing a pattern of signals corresponding to the pattern of vibrations;

a processor to convert the pattern of signals into a first control signal and to produce a second control signal when at least one predetermined condition is met; and a controller to trigger a traffic device in response to the first and second control signal.

* * * * *